US008534365B2

(12) United States Patent
Dighe

(10) Patent No.: US 8,534,365 B2
(45) Date of Patent: Sep. 17, 2013

(54) APPARATUS AND METHOD FOR UNDERSEA OIL LEAKAGE CONTAINMENT

(75) Inventor: Shyam V. Dighe, North Huntingdon, PA (US)

(73) Assignee: Dighe Technologies Corporation, North Huntingdon, PA (US)

( * ) Notice: Subject to any disclaimer, the term of this patent is extended or adjusted under 35 U.S.C. 154(b) by 62 days.

(21) Appl. No.: 13/066,866

(22) Filed: Apr. 27, 2011

(65) Prior Publication Data

US 2011/0318107 A1 Dec. 29, 2011

Related U.S. Application Data

(60) Provisional application No. 61/398,269, filed on Jun. 23, 2010.

(51) Int. Cl.
*E21B 7/12* (2006.01)

(52) U.S. Cl.
USPC ..... 166/364; 166/363; 405/60; 405/205; 405/210

(58) Field of Classification Search
USPC ..... 405/52, 60, 63, 64, 203, 205, 210; 166/364, 363, 356; 210/170.09, 170.11, 210/747.5, 923
See application file for complete search history.

(56) References Cited

U.S. PATENT DOCUMENTS

| | | | | |
|---|---|---|---|---|
| 3,599,590 | A | 8/1971 | Rego | |
| 3,610,194 | A * | 10/1971 | Siegel | 114/257 |
| 3,653,215 | A | 4/1972 | Crucet | |
| 3,658,181 | A | 4/1972 | Blair | |
| 3,666,100 | A | 5/1972 | Madej | |
| 3,670,814 | A | 6/1972 | Childers | |
| 3,681,923 | A | 8/1972 | Hyde | |
| 3,756,294 | A | 9/1973 | Rainey | |
| 4,283,159 | A | 8/1981 | Johnson et al. | |
| 4,643,612 | A | 2/1987 | Bergeron | |
| 5,035,536 | A | 7/1991 | von Winkelman | |
| 5,213,444 | A | 5/1993 | Henning | |
| 2006/0065392 | A1 | 3/2006 | Davila | |
| 2009/0324336 | A1 * | 12/2009 | Fossen et al. | 405/116 |

* cited by examiner

*Primary Examiner* — Sean Andrish
(74) *Attorney, Agent, or Firm* — Buchanan Ingersoll & Rooney PC

(57) ABSTRACT

Apparatus and method for containing and recovering undersea oil or gas well leakage by reason of the leaked fluid being lighter than sea water may include a canopy, or a series of interconnected canopies, which, when placed over a leak site, allow leaked fluid to be captured and displace sea water with the canopy or series of canopies having an arrangement, such as one or more conduits, for flow of leaked fluid upward from a respective canopy to the surface. With a system with multiple canopies in a series with exit arrangements for leaked fluid from a lower canopy to a next upper canopy, the series can readily extend from the surface to a great depth and allow transfer of volumes of the leaked fluid that are not limited by the capacity of canopies or conduits at deep locations.

16 Claims, 6 Drawing Sheets

APPARATUS AND METHOD FOR UNDERSEA OIL LEAKAGE CONTAINMENT

RELATED APPLICATION

This application claims the benefit of U.S. Provisional Application No. 61/398,269, filed Jun. 23, 2010, which is hereby incorporated by reference.

FIELD OF THE INVENTION

The invention, in its several forms, relates generally to techniques for such things as facilitating the containment and recovery of a lighter-than-water substance, such as crude oil, emanating into a body of water from a source down from the surface of the body of water, such as from a leaking oil well at the bottom of a sea or ocean.

BACKGROUND

Off-shore oil drilling is widely practiced but is subject to concerns about harm to marine life and shoreline beaches, flora, fauna and habitations in the event of oil leakage which can be quite serious ecologically and economically as shown by the 2010 experience in the Gulf of Mexico, as one example.

Drilling techniques have been developed to an extent that allows successful drilling and oil recovery at very deep locations, such as a mile or more from the wellhead to the surface. The oil rig provides for travel of the oil through a pipe or conduit. There is also technology, such as the use of blow-out preventers, for preventing or limiting release of oil into the sea water in the event there is a failure in the structure at the wellhead. However, devices such as blow-out preventers are also subject to mechanical failure and the entire operation of an off-shore drilling rig or platform is subject to some risk of human operator errors that can result in serious leakage.

Such problems can occur in wells at any depth but can be aggravated in very deep water because the distance from the surface and the greater water pressure at such depths prevents or severely limits human and, also, robotic accessibility to the wellhead site. Likewise, those circumstances, combined with the pressure or force of oil discharged from the wellhead, make it difficult to cap or seal the well by massive closed structures or materials lowered from the surface intended to block the escape of any oil.

In addition to escaping oil, there can be massive volumes of gas escaping from the wellhead that is immediately subjected to the high pressure of the deep water plus the very cold temperature prevalent at great depths. These can cause gas, or other substances in the crude oil, to condense or freeze and interfere with passage of the oil through a conduit to the surface even after a closed structure is placed over the wellhead. Consequently, it can be necessary to additionally provide a way to improve recovery of the gases, as well as oil, from the leak site.

Prior efforts to devise leak containment systems have taken account of the well known fact that oil, and gas, from a leak site is normally less dense than sea water and will rise through the water toward the surface. However, it is not believed that prior systems are sufficiently practical in terms of one or more of their characteristics including material costs, the facility with which the necessary apparatus can be put in place, and the ease of confinement and recoverability of the rising oil and gas. The deficiencies of such known prior systems appear particularly to hinder their application in instances of leakages from sites that are quite deep, such as in excess of a mile.

The ultimate recourse is often to drill an auxiliary relief well through the sea floor to the underlying oil deposit to try to relieve pressure from the leaking well. That is a partial remedy, at best, that is quite costly and can take a long time to do.

Any strategies employed to stop or control serious leakage still tend to leave a major risk of harm from the already escaped oil, and that oil is difficult to clean up or recover economically.

Consequently, new techniques for dealing with undersea oil leaks are highly desirable in order to make existing off-shore oil wells less risky and to have better assurance of safety for drilling to occur at additional sites.

SUMMARY

Various forms of the invention are presented with several examples that take advantage of the difference in density between oil that escapes into sea water and the sea water itself and which are readily adaptable to leak sites of any depth, including those more than a mile below the surface.

Techniques are presented that can make the depth of the leak relatively insignificant. Deep water distances, pressures and temperatures are not a serious impediment to the practice of these techniques, which also show considerable opportunity for rapid deployment at modest cost.

Briefly, and by way of example, an inventive apparatus can include one or more canopies with certain related structures to be described. For this example, a "canopy" is an open-sided enclosure such as a sheet of material that is at least substantially impervious to both oil and water (at least when no substantial pressure differential exists on opposite sides of the sheet, which is the case most expected). A canopy can, by way of further example, be like or similar to the material and configuration of a hot air balloon, without its ancillary basket, heater, and gas fill.

If one canopy is used, it can be arranged with a main cable to, and through, its top center (in a liquid tight fitting) to a location within a volume enclosed laterally by the canopy with some peripheral canopy locations connected by tie cables to the main cable with weights at some of the same or different locations of the canopy periphery for gravity descent of the canopy through the water. A canopy does not need to fit around its whole periphery securely against the sea floor; it is open enough to permit easy entrance and exit of liquids, in both directions, between the canopy and the sea floor, or through openings near the bottom of the canopy. Some additional lateral rigid structure can be included, if desired, as part of the weight structure to make sure the canopy stays in a substantially fully open orientation. A weighted ring around the bottom of the canopy, with openings for fluid exchange, can avoid any need for a lateral structure. A cross-section diameter of about 25 feet to 50 feet is a convenient size for the open side of the canopy for some applications where that size is sufficient to cover a wellhead, including features at the wellhead such as a blowout preventer.

Various other forms and arrangements of canopies will be described in the text below.

To practice a method in accordance with an example of the invention, with a single canopy apparatus, steps are performed that include lowering the main cable of the apparatus into the sea over the leak so that the weighted canopy vertically covers the wellhead and the peripheral weight at the canopy edge holds it in place against the sea bottom while openings at the periphery of the canopy allow sea water under the canopy to be displaced by oil from the leak, because the oil (as well as any gas) will rise in the water due to the differential density.

If the single canopy were allowed to fill completely with oil, subsequent oil from the leak would again escape; the canopy is not, in this example, intended to totally enclose it. To avoid this, a step is performed of drawing oil out of the top inner portion of the canopy while it is so placed. This oil can be withdrawn, for example through one or more flexible conduits that descend with the main cable to the top of the canopy.

In this way, as soon as the invention is used, which can be done quite rapidly, two functions are performed: one is that the oil from the leak is contained to minimize any escaping into the sea water and, two, the oil can instead be readily recovered and used without extensive cleanup operations.

In some examples, a multi-canopy apparatus is used and can provide greater convenience for leaks at greater depths and larger leaks with oil quantities greater than those conveniently removed by a conduit from a single canopy. Here, a first canopy can be as described above and one or more additional similar canopies, each with some peripheral weights and openings for fluid interchange, are attached at their centers in series on the main cable above the first canopy. Each successive canopy can, for example, be the same size or successively larger in cross-section than the one below it. The number of canopies applied in a multi-canopy system is readily varied to extend from a deep leak to the surface with means for upward, confined, transfer of the leaking fluids between canopies to the surface.

A method of operating with a multi-canopy apparatus can include allowing any oil that exceeds the capacity of any conduit from the first canopy to rise from the first canopy into the second canopy and successively up the entire series of canopies which can be up to sea level. Oil in the final canopy can be readily withdrawn. In addition, oil from the flexible conduit from the first canopy or from any additional conduits from other intermediate canopies can result in more complete recovery of the leaking oil. For a leak from a depth of one mile approximately 25 to 50 canopies in series might be used, each about 25 to 50 feet across at the bottom and having a vertical dimension of about 100 to 200 feet. However, there is a wide choice of sizes and shapes of canopies that can perform the functions of containing and recovering the oil.

Various embodiments of the invention are shown by way of example. A common aspect of them is that advantage is taken of the lighter density of leaked oil (or gas), or at least a substantial amount of what may leak, compared to the density of sea water and they are readily adaptable for use at leaks of any depth. The use of such innovations has the potential of avoiding a great deal of expense and damage.

Further explanations and examples of various aspects of the invention are presented below.

FURTHER DESCRIPTION OF EXAMPLES

Figure 1:
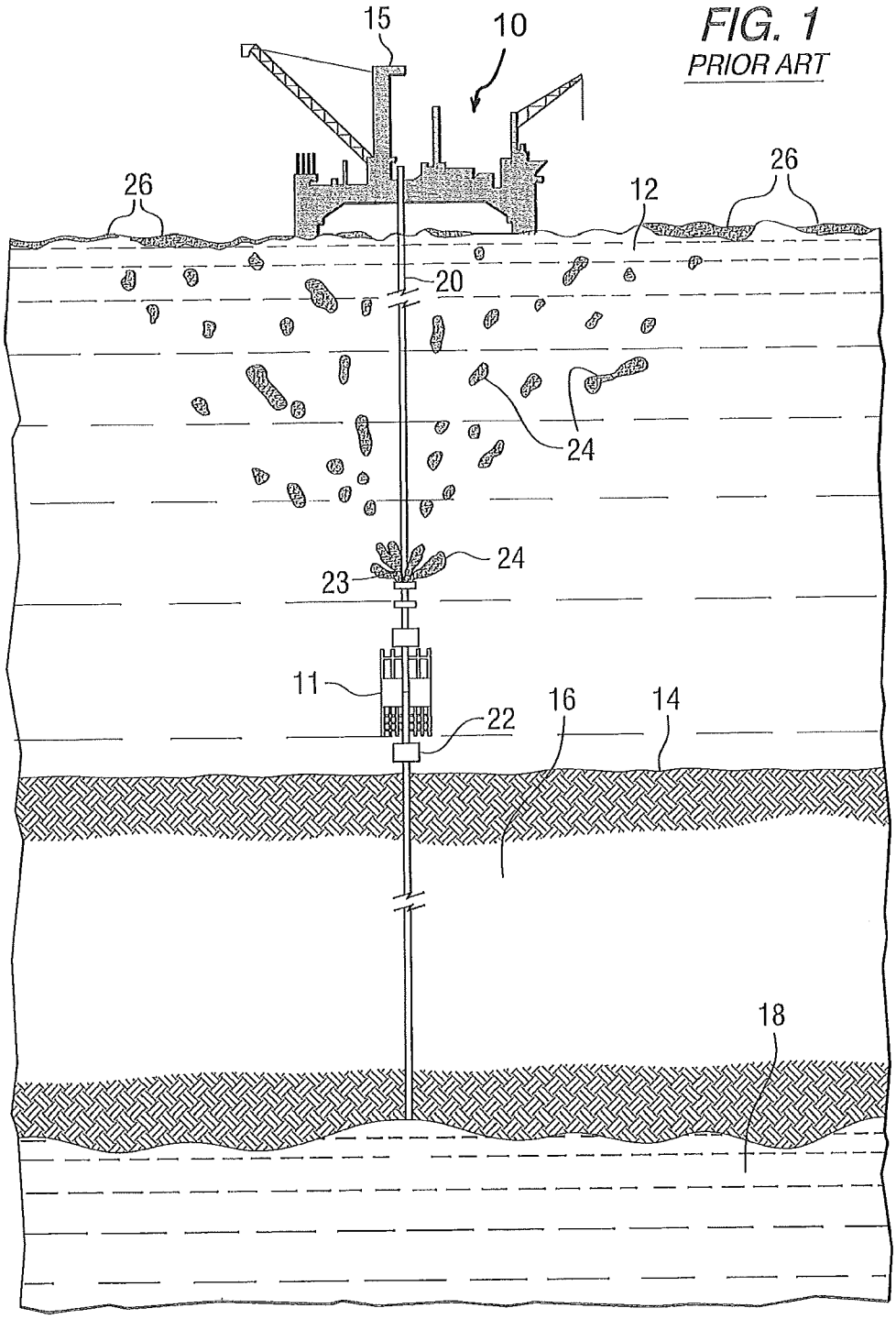
FIG. 1 PRIOR ART
FIG. 1 is a generalized schematic view of an offshore oil platform, well, and oil leak as an example of prior art without the present invention.

Referring to FIG. 1, an example of an off-shore oil platform 10 is shown on a body of water 12. The platform 10 supports a rig 15 that in turn supports well drilling and/or oil recovery equipment that extends through the water 12, a sea floor 14 (e.g., soil, sand, etc.), and a layer of bedrock 16, into an oil reservoir 18. For purposes of this illustration, such equipment is represented by a single pipe element (i.e., a drill pipe) 20 extending from the platform 10 to the oil reservoir 18 through the other strata, including the water 12, the sea floor 14, and the bedrock 16. The entry point of the drill pipe 20 into the sea floor 14 represents an oil wellhead 22.

The wellhead 22 is typically attached to the drill pipe 20 by a blowout preventer (BOP) 11 for the purpose of preventing oil from gushing out into the water 12 if there is damage to the drill pipe 20 or other equipment of the rig 15.

A failure or breakage causing a serious leak giving rise to a need for a remedy, as the following invention embodiments provide, might occur anywhere in the system, either at, above or below the BOP 11 or the wellhead 22. In this illustration a failure or breakage has occurred at a point 23 of the drill apparatus that allows oil 24 to escape from its intended passageway in drill pipe 20 into the water 12. Once there, it rises because it is lighter than the water 12 and is subject to currents and tidal forces to drift over the water surface and form an oil layer (or oil slick) 26 that can extend over a very large area. The invention (not shown in FIG. 1) controls the rise of the oil 24 from wellhead 22 and prevents or at least minimizes any oil layer 26 at the surface.

Figure 2:
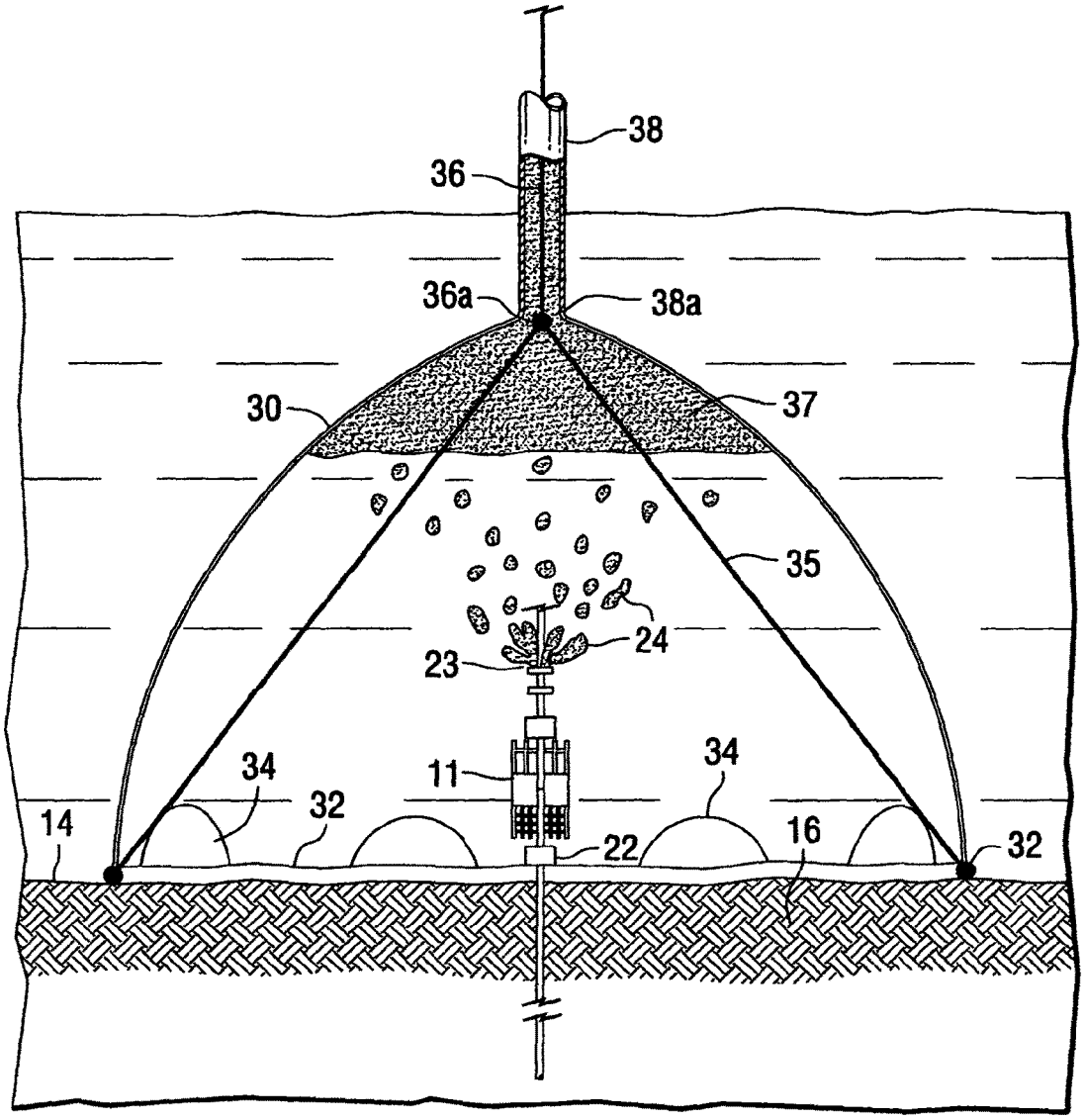
FIG. 2 is an example side-elevation illustration of a canopy arranged for practice of one form of the invention.

FIG. 2 shows an example of one simple form of an apparatus to help explain the buoyancy principle involved in its operation. It and some of its suitable variations will be described. The view of FIG. 2 can be understood as showing the addition of various elements to a leakage situation as shown in FIG. 1. In FIG. 2, most of the FIG. 1 drill pipe 20 is not shown because it is either removed or otherwise irrelevant.

A canopy 30 is shown that is similar in shape to an umbrella, or it could be thought of as similar to a hot air balloon turned upside down so its narrowest part is at the top, and with a section of the former top removed. It can be generally round with a generally circular perimeter at the bottom of the canopy. As will be seen, the particular shape of the canopy is not limited to that shown. For example, it need not be so hemispherical, it could have a more tapered configuration (like that of a hot air balloon as mentioned above). It is also not necessarily round, and its vertical dimension can be significantly greater compared to its horizontal dimension than that shown here.

The canopy 30 can be of any material that is capable of preventing fluids (i.e., oil or water) from passing through it. Hot air balloon type material is just one example. A flexible and collapsible material may be chosen for convenience in transport and storage but a rigid canopy can also be suitable. The example illustration of FIG. 2 assumes the material of the canopy 30 is transparent enough to see its interior and the elements discussed below.

Some elements of and with the example canopy 30 are a weight 32, either unitary (such as a thick metal cable) or in multiple elements, at the bottom edge or periphery of the canopy 30. Here the weight 32 is shown as a strip or ring, such as of steel cable fastened to and extending more or less continuously along the bottom edge of the canopy 30. Additional weights (not shown) may be attached to opposing points of the weight 32, outside the canopy 30, in this example. Many different forms of weights could be provided with, or instead of, the weight 32.

Another aspect is that there are openings 34 occurring at various locations at the bottom of the canopy 30. The openings 34 are to allow water to pass relatively freely from the inside to the outside of the canopy 30. The size, shape and exact location of the openings can be quite variable as will be apparent from the ensuing description of the operation of the apparatus.

FIG. 2 also shows the canopy 30 has attached to its upper surface a main cable 36 for support and placement of the canopy and a conduit 38, coaxial with the cable 36, for withdrawal of fluid (oil and/or gas) 37 from the upper volume of the canopy 30.

The cable 36 is for lowering the canopy 30 into the water over the wellhead 22 of FIG. 1. The weight 32 is to overcome buoyancy and allow the canopy to descend. (It is possible the material of the canopy 30, such as a rigid canopy, is heavy enough without additional weight.)

The cable 36 can be affixed to the canopy 30 at a joint (not shown), which is preferably at or near where the conduit 38 meets the canopy 30. Often this would be a fluid tight joint; the tightness of the joint is less important if the cable 36 has one or more additional canopies above the one shown. Alternatively, or additionally, the cable 36 may be affixed to the weight 32 by means of tie cables 35 that extend from the main cable 36 at a joint 36*a* to points on the weight 32. All the mechanical elements described may take a variety of forms to perform their indicated functions.

The canopy 30 with the conduit 38 is an example primarily for, but not restricted to, an arrangement with a single canopy 30 on a cable 36. Where present in a single canopy arrangement the conduit 38 may have a fluid tight joint 38*a* with the canopy 30 so oil can be safely transferred to the platform above and then transferred elsewhere as desired.

While a single canopy 30 as shown in FIG. 2 can be useful by itself in some situations, it has some inherent limitations including that the recoverable volume of leakage fluid (oil and/or gas) from the well head 22 is limited by the capacity of the conduit 38. In some situations, including many deep water leaks, it would be desirable not to be so limited by the capacity of a conduit extending a great distance. Since it may not always be possible to tailor a single canopy and such a conduit to specifics of an actual leak situation, it is more preferable to have a leak containment system versatile enough to be readily adapted to a variety of situations, including where a leak is from a very low depth and the volume of leakage fluid may be quite large. In order to achieve greater versatility and capability in those respects, examples of multiple canopy leak containment and recovery apparatus are described below.

In a multiple canopy arrangement, oil could be withdrawn to the surface from any, but not necessarily all, of the canopies. It is usually the case for at least the uppermost canopy of a series of multiple canopies to have a conduit for recovery of substantially all of the leakage fluid. That conduit can be joined to the uppermost canopy at or near the sea surface so it can be selected for attachment, or replaced if needed, to have a size for adequate capacity. Reference to "a conduit" herein is, of course, not meant to restrict an embodiment of the apparatus to only a single conduit from a particular canopy; multiple conduits may be applied as needed or desired.

Figure 3A:
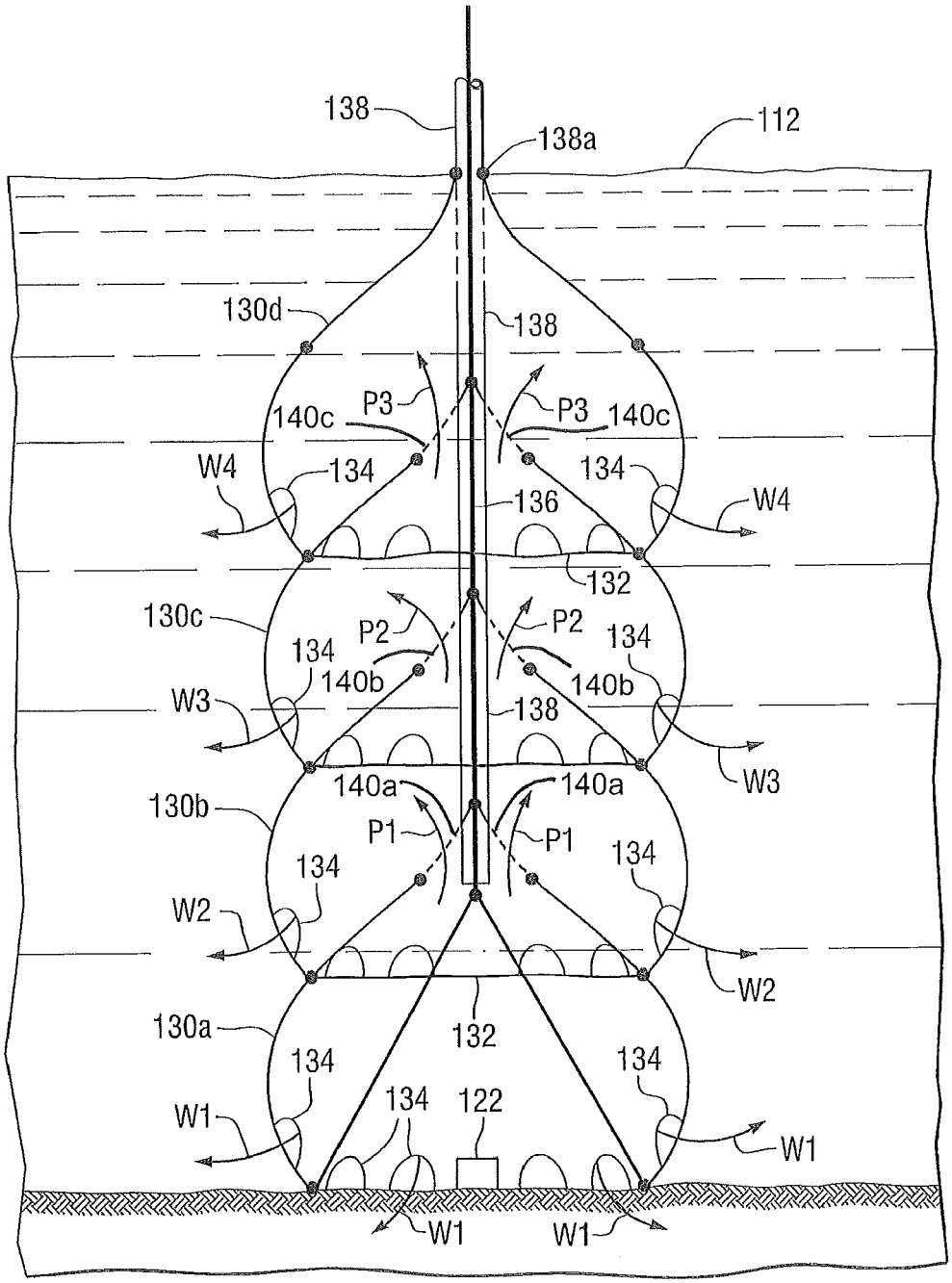
FIG. 3A is a side-elevation of an example of the invention with multiple canopies.

FIG. 3A gives an illustration of a multiple canopy apparatus that includes a series of canopies 130*a, b, c*, and *d* along the length of a cable 136 that extends from a sea surface 112 to a sea floor and a leaking oil wellhead 122. This view schematically shows the relation of the canopies to each other and the flow of fluids within and out of the canopies. The canopies themselves are merely shown as examples with simplified construction, which could take many different forms in practice.

Oil from the wellhead 122 rises within the bottom canopy 130*a* and displaces water (represented by arrows W1) that passes out through openings 134 like or similar to openings 34 of FIG. 2.

In the example of FIG. 3A, a conduit 138, coaxial with the cable 136, extends from the canopy 130*a* through all the upper canopies 130*b, c*, and *d* to the surface 112 and oil rising in the first canopy 130*a* can be withdrawn through the conduit as in FIG. 2. The bottom canopy 130*a* and conduit 138 can contain and remove all the oil from the wellhead 122 as long as that oil does not exceed the capacity of the canopy 130*a* and the conduit 138. In that case, additional canopies 130*b*, 130*c*, and 130*d* would not need to be present or, if they were, would not need to be used to collect oil. The following description of FIG. 3A is for the case in which the one canopy 130*a* and the conduit 138 may not be of sufficient capacity and the additional canopies are used.

The first canopy 130*a* is provided with one or more openings 140*a* at its top for upward flow of oil that is not withdrawn, by suction, through the conduit 138 which has an open end in the canopy 130*a*. The oil flowing through the openings 140*a* is represented by the arrows P1 indicating oil (petroleum) flowing from the inner volume of the first canopy 130*a* into the second canopy 130*b*. (The conduit 138 and openings 140*a* for the oil flow P1 (either one or both together) are examples of elements of what is sometimes referred to herein as an "exit arrangement" for removal of fluid from a canopy.)

The second canopy 130*b* can be (but need not be) similar in size, shape, and overall features as the first canopy 130*a*. The second canopy 130*b* is physically attached to the first canopy 130*a*. For example, a cable 132 or some other weight element on the lower edge of the second canopy 130*b* can be secured, such as by loops (not shown), to the outside of the upper part of the first canopy 130*a*. A similar relation and attachment may be present between each successive pair of canopies.

FIG. 3A shows the oil flow P1 entering the second canopy 130*b* where it displaces water out of lower side openings 134 of that canopy represented by arrows W2. Similarly, each of the additional canopies 130*c* and 130*d* are related to its adjacent lower canopy in a like manner. (Dashed lines through which arrows P1, P2, and P3 extend are to show the openings 140*a*, 140*b* and 140*c* for the rising leaked oil and fluid in the respective canopies to the next higher canopy.) Oil flow P2, flowing through openings 140*b* in canopy 130*b*, displaces water W3 from canopy 130*c*. Oil flow P3, flowing through openings 140*c* in canopy 130*c*, displaces water W4 from canopy 130*d*. It is normally intended the uppermost canopy, here the canopy 130*d*, has all oil it collects removed from it via the conduit 138, which has a fluid-tight joint 138*b* to the canopy, and no other upper openings in the canopy 130*d* are provided. To do so, a section of conduit 138 within the upper part of canopy 130*d* has openings (example perforations being shown by dashed lines on two sides of the conduit 138 in the drawing) to draw in oil flow P3 that has risen from the canopy 130*c* below. Also, the upper extremity of the conduit 138 can be wider than lower parts to accommodate the total volume of leakage fluid. That upper extremity can be replaced as needed and that can be readily done because of its location at the surface. (Not all details of such an arrangement are shown in FIG. 2.)

Either or both of the intermediate canopies 130*b* and 130*c* may also be arranged to feed oil into the conduit 138, such as by windows into the conduit at locations near the top of the respective conduits, as can also be the case with respect to the uppermost canopy 130*d* and the conduit 138. (Such windows, or additional openings, in canopies 130*b* and 130*c* are optional and are not shown in FIG. 3A.)

It is of course the case that the conduit 138 may, at least initially, carry sea water to the surface or sea water mixed with oil. That would frequently be quite all right. In some cases there may be apparatus modifications applied so that fluid drawn out by the conduit 138 contains at least a preponderance of oil. For example, such modifications may use sensor elements to determine oil is occurring at inlets to the conduit before any pump or suction apparatus (not shown) related to the conduit 138 is activated. In addition, any openings from the canopies into the conduit 138 could be provided with covers that are openable or closeable for any reason determinable from the surface or from conditions in the water learned by monitoring equipment.

In a multi-canopy arrangement as shown in FIG. 3A, the openings 140*a*, 140*b* and 140*c* for the oil flow indicated at P1, P2, and P3 could be openings present at all times. Alternatively, some or all of such openings may result only after some determination they are in fact desirable in the case of a particular oil leak. For example, if sensors are present that suggest the flow may exceed the capacity of canopy 130*a* and conduit 138, and the canopy 130*a* has normally closed upper openings that are subject to being opened by some triggering signal, (automated or manually inputted), the triggering signal could be provided to remove or open part of the canopy 130*a* and produce the passages for the oil flow indicated at P1. Such a system might, for example, use wireless communication from some monitoring location to trigger an opening device on the canopy. For example, a section of the canopy may be configured to be normally secured to the rest of the canopy but forcibly removable by a force resulting from a trigger signal. This could be like firing a compressed air device disposed on the under side of the removable canopy material. Equipment similar to that used for automotive air bag deployment may be applied here.

Figure 3B:
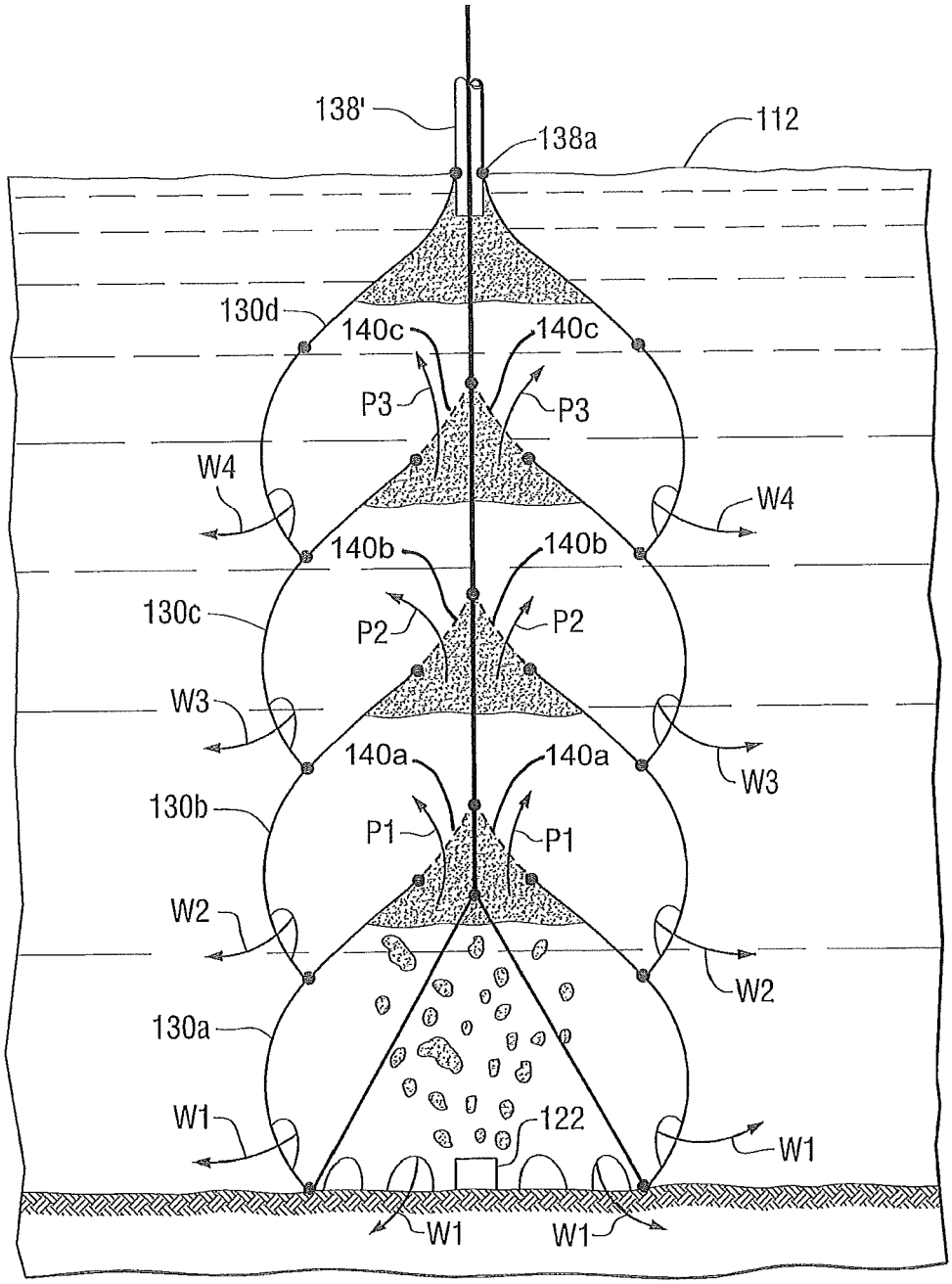
FIG. 3B is a modified example of apparatus similar to that of FIG. 3A.

A system is shown in FIG. 3B that is similar to the system of FIG. 3A except here the oil is intended to pass through each canopy 130*a*, 130*b* and 130*c* in succession (shown by the arrows P1, P2, and P3) until it reaches the uppermost canopy 130*d* which is the only one into which the conduit 138' extends, and all of the oil from the wellhead 122 is removed by the conduit 138' from the canopy 130*d*.

Figure 4:
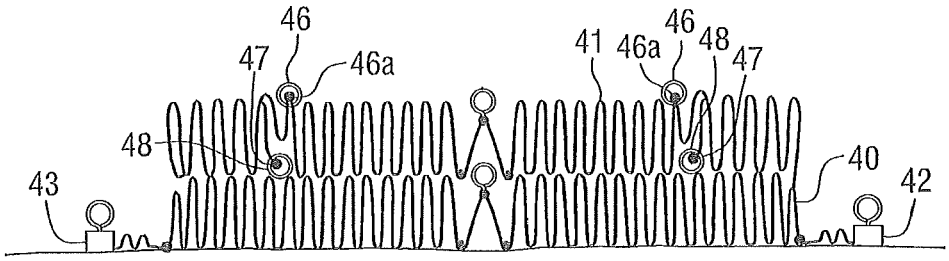
FIGS. 4 and 5 are, respectively, side elevation and plan views of examples of canopy elements according to the invention before deployment; and, FIG. 6 is a schematic of an example of an arrangement for practice of a method in accordance with the invention.
Figure 5:
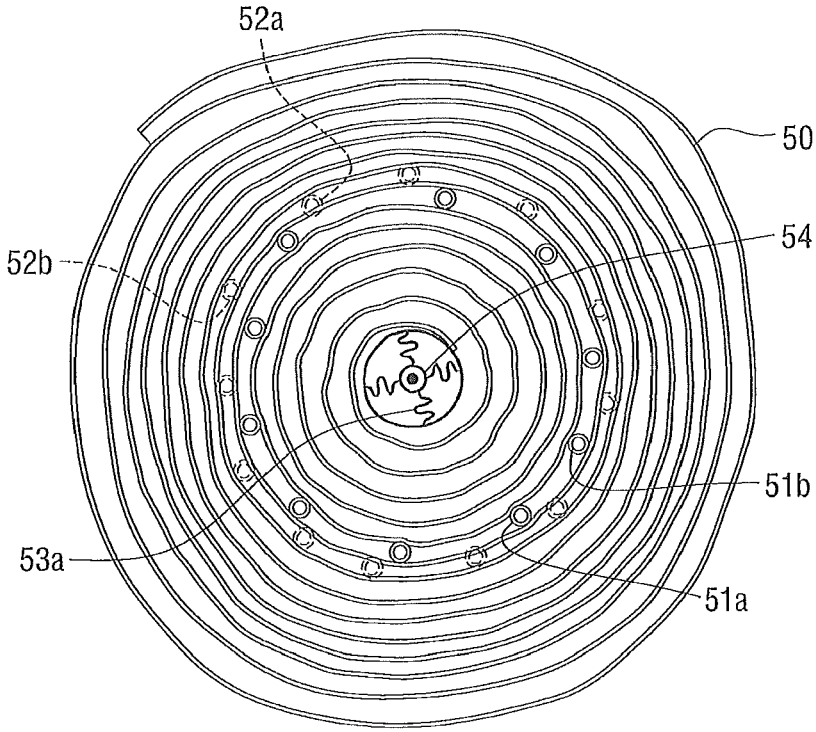

FIGS. 4 and 5 each illustrate the appearance of some examples of multi-canopy apparatus before being deployed, where the canopies are of fabric, or the like, that can be folded, or compressed, into a compact form from which it can be expanded for use in arrangements such as those of FIGS. 3A and 3B.

In FIG. 4, canopies 40 and 41, shown in a side elevation view, are of such a flexible material and are shown stacked with multiple folds in the canopy material. The bottom canopy 40 has lower peripheral weights 42 and 43. The upper canopy 41 is joined to the lower canopy 40 by a cable 47 secured to the upper canopy lower edge passing through loops, such as at 48, on the outer surface of the lower canopy 40. Similarly, the upper canopy 41 shown here has loops 46 that can be for joining with a third canopy (not shown except for a cable 46*a* that could be part of a third canopy). Loops, such as 46 and 48, may be arranged at locations on the outer surface of a canopy for fixing its relation to a canopy above it by a cable, such as 46*a* or 47, respectively, through those loops. Various other means for joining, or holding in place, successive canopies may be employed. In addition to loops and cables, stitching, velcro, weight elements, spring elements, or some combination of the mentioned elements, are just some of the suitable possibilities.

FIG. 5 illustrates a plan view of a canopy 50 of a multi-canopy series. The canopy 50 covers one underneath it that is represented by the loops 52*a* and 52*b* through which a lower cable (not shown) of the upper canopy 50 may extend. The canopy 50 also has loops 51*a* and 51*b* that are available for joining an additional canopy to the top of the canopy 50. Also shown is a central main cable 54 and tie cables 53 that could be utilized like the corresponding elements of the prior figures. The multiple lines between the outer edge of canopy 50 and the main cable 54 merely represent folds of the collapsed canopy material.

Conduit elements are, for simplicity, not more clearly shown in FIGS. 4 and 5 but may be provided as previously described and as illustrated in FIGS. 2, 3A, and 3B, and may be flexible, coiled material as well as rigid material. Conduit elements may be assembled with the canopies at any time before their use together.

Figure 6:
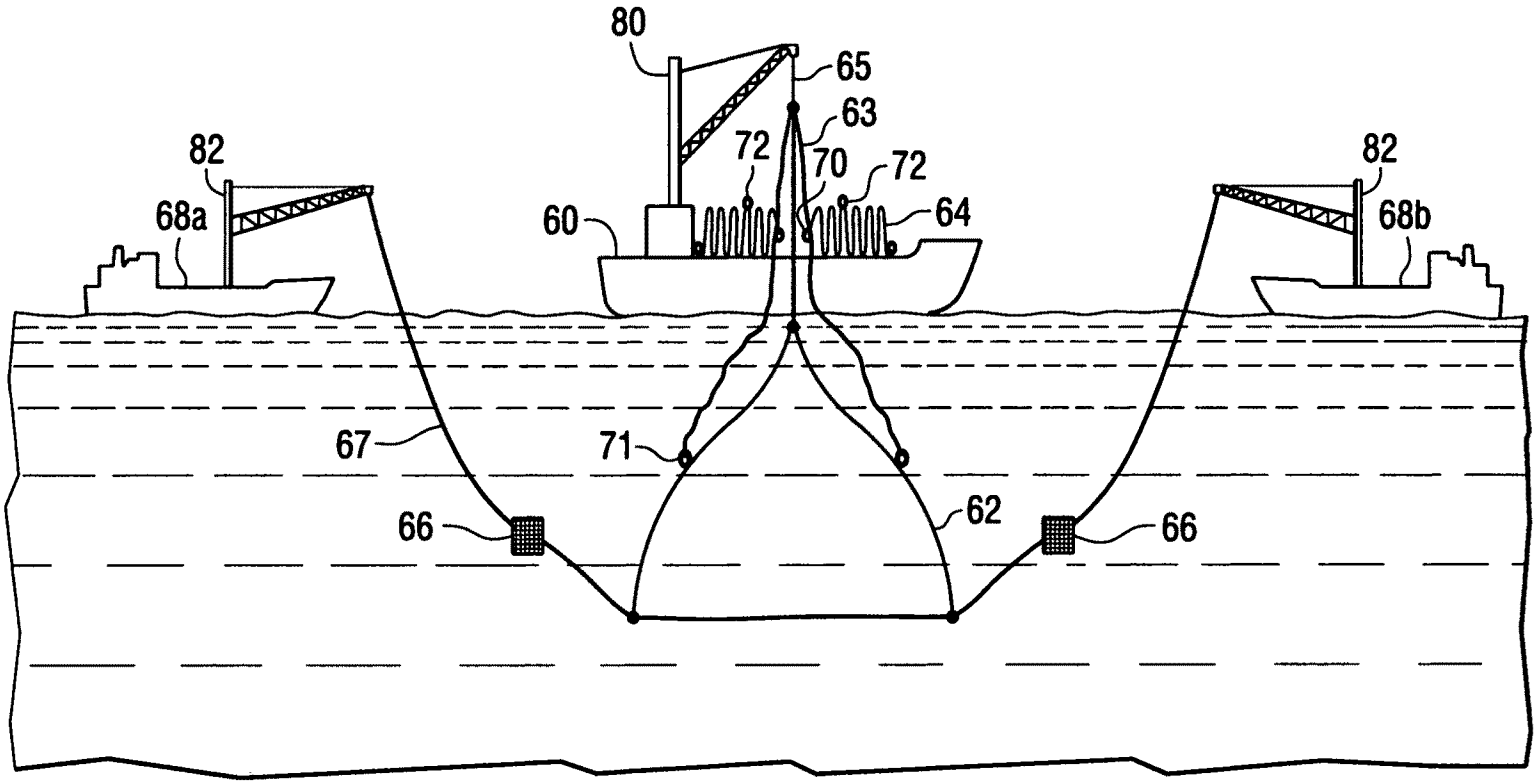

FIG. 6 shows an example of the method of using some example apparatus of the invention. Here, a ship 60, which may be the original oil rig platform (like 10, of FIG. 1), or another vessel, is positioned over a wellhead (not shown) for placement of an apparatus including canopies 62, 63, and 64 by a crane or hoist 80 and cable 65. The canopies 62, 63 and 64 may be interrelated as shown in some of the previous examples with locations for loops and cabling at 70, 71, and 72.

The example of FIG. 6 further includes a pair of auxiliary boats 68*a* and 68*b* that have hoists, such as 82, to assist by placing weights, such as weight 66, attached to cables, such as 67, that are joined with the first canopy 62.

Various modifications of the above examples will be apparent. A few particular variations will be mentioned by way of further example.

The systems as described above can be readily compacted for transport or storage and can be readily placed in a location over a wellhead, or a ruptured oil pipe, or the like, that is under water even if not right at a wellhead. This can be done quickly, especially if a drilling platform is equipped with the apparatus before it is needed.

In addition, a system can be designed for placement in the water over a wellhead upon or during initial drilling of a well, or any time thereafter, as a security measure even before any leakage occurs. Such a system can be placed over and around the initial drilling equipment and the piping placed in the drilled well. Whenever any leakage occurs, the leaked oil will be captured by the system and extracted through the conduit or conduits built into the system.

A further alternative is to have a system in place on the sea floor at a wellhead but not in an operational position until it is drawn up by a cable to form the oil capturing structure in an operational position along with conduiting to remove the oil. This would provide both non-interference with normal drilling and well extraction operations and, also, not require storage of the system on the platform.

One alternative type of system to those previously described that still utilizes the principle of displacement of water by the rise of lower density oil is one in which a series of multiple canopies are arranged in a manner similar to those of FIG. 3A or 3B but configured so that oil can exit a lower canopy back into the sea water when that canopy is completely filled and still be captured (at least to some extent) by a higher canopy. (That is, an exit arrangement for leaked oil from a canopy may be, or include, passage of the oil out from under a lower edge of a canopy.) For instance this might be desirable if the leakage is at a very high rate that is greater than what can be readily extracted by an arrangement such as that of FIG. 3A. In the FIG. 3A system, if the total volume of the lowest canopy 130*a* becomes overfilled with oil despite what passes out through the conduit 138 and the openings 140*a* to the next canopy 130*b*, some oil may leak out through the openings at the bottom though which water flowed (arrows W1).

For this alternative system, as one example, consider a series of canopies that are each in a form of something like a hemispherical umbrella (e.g., similar in shape to canopy 30 of FIG. 2), where each successive canopy up from the bottom is larger in diameter than the one below it and is open to an extent it captures oil that rises from the periphery of the canopy below. If oil were to exit through openings in, or around the bottom edge of a lower canopy it (or at least a substantial part of it) would rise in the sea water to reach the next upper canopy and the successive canopies would operate in the same manner up to the top canopy in the series.

A system as just described can have conduiting for oil from any of the canopies, including at least the uppermost canopy. Depending on the leakage rate, it is possible the conduiting takes care of all the oil without any exiting a canopy back into the water, in which case an arrangement of successive canopies, that are open from the bottom and able to intake oil from the next lower canopy, is not necessary but serves as additional security in case the leakage changes or any blockage of a conduit occurs.

As mentioned previously, canopies of the described systems may be highly flexible which permits compacting them for convenient transport and storing. They may also be of rigid material with otherwise similar characteristics as those of a flexible material. For example, they could be of molded plastic, fiberglass, or of metal of a thickness no more than one inch. Rigid canopies, such as for the system of successive umbrella shaped canopies described above, could be stacked for storage when not in use and in some applications may be preferred to be rigid to have them extend over the desired area more readily.

While the description here is directed to applications such as deep water oil leaks, it is to be understood the invention can also be applied in other instances for capturing a material released at some distance below the surface into a fluid medium that has a greater density than the material desired to be captured.

Consequently, it can be seen from the above description of examples, as well as the following claims, that capturing and recovering a fluid, such as oil or gas leaking from an undersea wellhead, can be performed with reasonably simple apparatus that can be made and used economically and can result in avoiding or limiting damage that could otherwise result and still permits making use of the oil or gas which need not be subjected to adulteration by use of the invention.

What is claimed is:

1. A leak containment system, suitable for operation at an undersea leak site of a leakage fluid including any one or more of oil and gas from a sea floor wellhead into sea water, comprising:

a series of a plurality of interconnected canopies, each canopy being of material impervious to fluid transfer and with predetermined openings in the canopy material for fluid passage between an interior and an exterior of the canopy;

the series of canopies being weighted sufficiently for descent by gravity through the sea water for placement of a first canopy over the leak site and each successively upward canopy in the series being atop a lower canopy;

each canopy being formed as, or being expandable into, a dome-like configuration with a peripheral bottom that is open and has one or more of the predetermined openings at or near the bottom allowing displacement of a quantity of the sea water from the interior to the exterior of the canopy by reason of entry of the leakage fluid and rising of the leakage fluid within the canopy;

each respective canopy of the series that has another canopy atop the respective canopy having at least one of the predetermined openings formed at a top portion thereof for leakage fluid to rise from a lower canopy into a next higher canopy;

an uppermost one of the series of canopies being provided with a conduit for transfer of the leakage fluid to an above sea level location.

2. The system of claim 1 wherein:

the conduit extends through the plurality of interconnected canopies and includes openings disposed at or proximate a top of a lower canopy for transfer of the leakage fluid from a lower canopy through an upper canopy via the conduit and for transfer of the leakage fluid into the interior of the upper canopy with displacement of the sea water out through the predetermined openings at or near the bottom thereof.

3. The system of claim 2 wherein:

the at least one opening at a top of a first canopy confines flow of the leakage fluid to a second canopy above the first canopy.

4. The system of claim 1 wherein:

each of the canopies is of a flexible sheet material with a first canopy having one or more weight elements to rest on the sea floor around the leak site and a second canopy immediately atop the first canopy, wherein the second canopy has a bottom edge over and around the at least one opening in the first canopy with the bottom edge of the second canopy at a top of the first canopy.

5. The system of claim 4 wherein:

the conduit including openings disposed at or proximate a top of a canopy confines flow of the leakage fluid to an upper canopy at a sea level location.

6. The system of claim 2 wherein:

the conduit including openings disposed at or proximate a top of a canopy confines flow of the leakage fluid to an upper canopy at a sea level location.

7. The system of claim 1 wherein:

each of the canopies is of a flexible sheet material with a first canopy having one or more weight elements to rest on the sea floor around the leak site and a second canopy immediately atop the first canopy, wherein the second canopy has a bottom edge over and around the at least one opening in the first canopy with the bottom edge of the second canopy at a top of the first canopy.

8. The system of claim 1 wherein:

the at least one opening formed at the top portions of the plurality of interconnected canopies for the leakage fluid to rise from a lower canopy into a next higher canopy is normally closed and is opened under designated conditions to allow passage of the leakage fluid through the at least one opening.

9. A method for undersea oil leakage containment and recovery by use of the system of claim 1 and comprising the steps of:

lowering the series of canopies with a cable over a leak site so a first canopy covers the leak site;

allowing sea water to flow out of the first canopy through the predetermined openings thereof as a result of displacement by reason of entry of the leakage fluid from the leak site and rising of the leakage fluid within the first canopy;

passing the leakage fluid through successively upward ones of the canopies of the series of canopies via the at least one of the predetermined openings formed in the top portions of the respective canopies; and recovering a quantity of the leakage fluid at a surface location.

10. A method for undersea oil leakage containment and recovery by use of the system of claim 2 and comprising the steps of:

lowering the series of canopies with a cable over a leak site so a first canopy covers the leak site;

allowing sea water to flow out of the first canopy through the predetermined openings thereof as a result of displacement by reason of entry of the leakage fluid from the leak site and rising of the leakage fluid within the first canopy;

passing the leakage fluid through successively upward ones of the canopies of the series of canopies via the conduit including openings disposed at or proximate a top of the respective canopies; and recovering a quantity of the leakage fluid at a surface location.

11. A method for undersea oil leakage containment and recovery by use of the system of claim 8 and comprising the steps of:

lowering the series of canopies with a cable over a leak site so a first canopy covers the leak site;

allowing sea water to flow out of the first canopy through the predetermined openings thereof as a result of displacement by reason of entry of the leakage fluid from the leak site and rising of the leakage fluid within the first canopy;

passing the leakage fluid through successively upward ones of the canopies of the series of canopies via the at least one of the predetermined openings formed in the top portions of the respective canopies; and recovering a quantity of the leakage fluid at a surface location.

12. The method in accordance with claim 11 further comprising:

monitoring a leakage fluid content in one or more of the respective canopies; and initiating a triggering signal resulting in opening the normally closed at least one opening formed at the top portions of a respective canopy when the monitoring indicates a fluid content in the respective canopy has reached a predetermined level.

13. An apparatus for undersea oil leakage containing and recovery comprising:

a first means for partially enclosing a sea volume over and around a leak site and allowing leaked oil to rise and displace sea water within the sea water volume by reason of a lower density of the leaked oil, said first means including a series of interconnected canopies each of which includes means for entry of the leaked oil from a canopy immediately below and displacement of sea water from within, and a second means for recovering the leaked oil from the first means, wherein said second means includes any one or more of:

a conduit extending from the first means to a surface location, one or more openings provided in an upper part of a series of interconnected canopies that allow the rising leaked oil to displace the sea water in successively upward ones of the canopies, and an arrangement for the leaked oil initially captured by a first canopy that exceeds a capacity of the first canopy to exit under a lower edge of the first canopy and be captured by a second canopy located above the first canopy.

14. The apparatus in accordance with claim 13 wherein:

the series of interconnected canopies are of a sufficient number to extend vertically from the leak site to a surface level;

said second means includes a conduit extending from a first, lowest, canopy through each of the vertically upper canopies to the surface level; and, each canopy below an uppermost canopy has the one or more openings for upward transfer of the leaked oil to a next upward canopy and each canopy of the series has one or more openings for the sea water displaced by the leaked oil to transfer out from an interior of the canopy.

15. The apparatus in accordance with claim 13 wherein:

the series of interconnected canopies are of a sufficient number to extend vertically from the leak site to a surface level;

said second means includes the conduit extending from the uppermost canopy of the series to a surface location; and each canopy below the uppermost canopy has the one or more openings for upward transfer of the leaked oil to a next upward canopy and each canopy of the series has one or more openings for the sea water displaced by the leaked oil to transfer out from a canopy interior.

16. A leak containment system, suitable for operation at an undersea leak site of a leakage fluid including any one or more of oil and gas from a sea floor wellhead into sea water, comprising:

a plurality of interconnected canopies connected in series, one on top of another, each canopy being of material impervious to fluid transfer and with predetermined openings in the canopy material for fluid passage between an interior and an exterior of the canopy;

the plurality of canopies being weighted sufficiently for descent by gravity through the sea water for placement of a first canopy over the leak site and each successively upward canopy in the series being atop a lower canopy;

each canopy being formed as, or being expandable into, a dome-like configuration with a peripheral bottom that is open and has one or more of the predetermined openings at or near the bottom allowing displacement of a quantity of the sea water from the interior to the exterior of the canopy by reason of entry of the leakage fluid and rising of the leakage fluid within the canopy;

a conduit extending through the plurality of interconnected canopies from an uppermost canopy to a lowermost canopy, the conduit including openings disposed at or proximate a top of a lower canopy for transfer of the leakage fluid from a lower canopy through an upper canopy to an above sea level location via the conduit, and for transfer of the leakage fluid from the lower canopy into the interior of the upper canopy with displacement of the sea water out through the one or more predetermined openings at or near the bottom thereof.

* * * * *